United States Patent [19]

Farrar et al.

[11] Patent Number: 4,997,714

[45] Date of Patent: Mar. 5, 1991

[54] ABSORBENT PRODUCTS AND THEIR MANUFACTURE

[75] Inventors: David Farrar, West Yorkshire; Adrian Allen, North Yorkshire; Peter Flesher, West Yorkshire, all of Great Britain

[73] Assignee: Allied Colloids Limited, United Kingdom

[21] Appl. No.: 354,612

[22] Filed: May 19, 1989

[30] Foreign Application Priority Data

May 20, 1988 [GB] United Kingdom ..... 8811955

[51] Int. Cl.[5] ..... B32B 27/02

[52] U.S. Cl. ..... 428/394; 428/396; 428/523; 264/210.1; 264/210.3; 264/210.4; 264/211; 264/129; 264/134; 264/205

[58] Field of Search ..... 523/322; 524/236, 556, 524/251; 526/318.4; 427/174; 428/394, 396, 523; 264/210.1, 210.3, 210.4, 211, 129, 134, 205

[56] References Cited

U.S. PATENT DOCUMENTS

| | | | |
|---|---|---|---|
| 3,926,891 | 12/1975 | Gross et al. | 523/412 |
| 3,980,663 | 9/1976 | Gross | 524/389 |
| 4,057,521 | 11/1977 | Gross | 524/379 |
| 4,735,658 | 4/1988 | Blet et al. | 524/236 |
| 4,778,836 | 10/1988 | Farrar et al. | 524/556 |
| 4,861,539 | 8/1989 | Allen et al. | 264/205 |

FOREIGN PATENT DOCUMENTS

| | | |
|---|---|---|
| 268498 | 5/1988 | European Pat. Off. . |
| 269393 | 6/1988 | European Pat. Off. . |
| 2355929 | 2/1978 | France . |

OTHER PUBLICATIONS

Nakajima, Nobuyuki, "Fractionation of Linear Polyethylene with GPC", Advances in Chemistry Series 125, ACS, Washington, DC (1973).

Tadmor et al., *Principles of Polymer Processing,* John Wiley & Sons, New York, 1979, pp. 542–543.

Billmeyer, Jr., Fred. W., *Textbook of Polymer Science,* 3rd Ed., John Wiley & Sons, New York, 1984, pp. 16–18.

*Primary Examiner*—Joseph L. Schofer
*Assistant Examiner*—R. H. Delmendo
*Attorney, Agent, or Firm*—Ostrolenk, Faber, Gerb & Soffen

[57] ABSTRACT

Film or fibre is made from a polymer of water soluble ethylenically unsaturated monomeric material that includes ionic monomer by extrusion and stretching, and a counterionic lubricant compound is absorbed into the surface of the fibre or film before or during the stretching. The counterionic lubricant compound is also of use for providing a lubricated film on other extruded or comminuted elements of water swellable or water soluble polymeric material.

13 Claims, No Drawings

ABSORBENT PRODUCTS AND THEIR MANUFACTURE

This invention relates to dried polymeric materials that have high water absorbing capacity and that are formed from ethylenically unsaturated monomeric materials comprising ionic monomer. It is well known that such materials can have a slightly sticky surface and that this can interfere with the automated and high speed handling of the materials. The surface properties can cause a particular problem when the materials are being made initially by drying, or when exposed to very humid conditions.

The invention relates particularly to water absorbent, water insoluble, polymeric fibre or film that is useful for absorbing aqueous fluids, for instance urine.

It is known to make absorbent fibres by shaping an aqueous solution of a substantially linear polymer and then cross linking it in its shaped configuration. Reference is made to U.S. Pat. Nos. 3,926,891, 3,980,663 and 4,057,521, and FR 2,355,929. In particular, it is known to extrude the solution through a spinning orifice so as to form fibres. Particular compositions for such fibres, and methods of making them, are described in our unpublished European applications 87310293.3 and 7310294.1.

It is naturally important that the process should be capable of being operated continuously and this requires that the fibre or film that is being extruded does not break during extrusion and subsequent processing steps. As indicated in those European applications spinning lubricants can be used during the production of the fibres or films.

Another situation where a surface lubricant is required is when particles are being made by comminution and drying of polymer gel. It is known to incorporate a small amount of a non-ionic surfactant, such as polyethylene glycol, in the gel at the time of comminution in order to minimise aggregation of the particles, for instance during fluid bed drying, but these and other known lubricants are not entirely satisfactory, both from the point of view of their lubricating properties and from the point of view of the properties they impart to the final polymer. For instance a lubricant that greatly affects surface tension can interfere with the absorption performance of the polymer.

According to the invention we provide a dried extruded or comminuted element of a water swellable or water soluble polymeric material formed from water soluble ethylenically unsaturated monomeric material comprising ionic monomeric material and on to the surface of which a counterionic lubricant compound has been absorbed.

The invention is of particular benefit when the element is an extruded film or fibre that has been stretched and that is formed of a water insoluble, water swellable, polymer having very high absorptive capacity For instance the polymer preferably absorbs at least 50 grams, and often at least 100, 200 or more, grams deionised water per gram dry weight of polymer at 20° C. The film or fibre is preferably made by extrusion into a gas atmosphere. Preferably the water-absorbent water insoluble cross linked polymer fibre or film is made by a process comprising extruding into a gas atmosphere a solution in a solvent of a substantially linear polymer formed of a water soluble monoethylenically unsaturated monomer or blend of monomers and thereby evaporating the solvent and forming polymeric fibre or film, stretching the fibre or film and cross linking the fibre and in this process lubricant is applied to the fibre or film before or during the stretching, the monomer or monomers comprises an ionic monomer, and the lubricant comprises a counter-ionic lubricating compound.

By the invention it is possible to make highly water absorbent fibre or film continuously and at high speed and to minimise, and substantially completely eliminate, the risk of breakage and blockage of the apparatus without significantly impairing the absorptive and other performance characteristics of the fibre or film.

The extruded polymer or the lubricant, or both, may be amphoteric and thus may contain both anionic and cationic groups. Under these circumstances a counter-ionic effect is considered to occur whenever the balance of ionic groups in either or both of them is such that, at the concentrations prevailing in the fibre or film on the one hand and the lubricant on the other, the lubricant interacts with the polymer of the fibre or film primarily in a counter-ionic manner, i.e., complexes are formed preferentially between the counter-ionic groups in the lubricant on the one hand and the fibre or film on the other, as opposed to complexes being formed within the lubricant or within the fibre or film.

Generally the polymer of the fibre or film is anionic in which event the lubricant will contain cationic groups, but may also contain non-interfering anionic groups.

The lubricant preferably contains at least one hydrophobic hydrocarbon group of at least eight carbon atoms. A preferred type of lubricant is a quaternary ammonium compound wherein there is at least one such hydrocarbon group substituted on to the quaternary nitrogen atom.

The hydrophobic group preferably contains at least 12 carbon atoms and most preferably at least 14 carbon atoms. Generally it contains not more than 24 carbon atoms. It may be provided as a blend of hydrophobic groups. For instance when, as preferred, it is a fatty aliphatic group this may be provided as a blend of aliphatic groups containing, for instance, between 14 and 20 carbon atoms. Some of the aliphatic groups can be unsaturated but preferably they are substantially all saturated.

It is particularly preferred that the quaternary nitrogen atom should be substituted by at least 2 of the hydrophobic groups. The remaining 2 (or 3) substituents on the quaternary nitrogen atom may be any of the groups conventionally present on quaternary nitrogen atoms such as Cl-4 alkyl, often methyl. The anion of the quaternary ammonium compound may be any of the conventional quaternary anions such as chloride or bromide.

The preferred quaternary compounds for use in the invention are di(fatty aliphatic)di(Cl-4 alkyl) ammonium compounds wherein the said aliphatic groups contain a mixture of one or more aliphatic groups having from 14 to 20 carbon atoms, most preferably hydrogenated tallow.

The amount of lubricant should be selected to give the desired performance properties but is usually in the range 0.01 to 5% dry weight based on dry polymer, the amount is preferably below 1%. Often it is above 0.05%, preferably above 0.1%.

The lubricant may be applied to the extruded fibre or film in the spinning orifice but generally it is applied after most or all of the solvent has been evaporated from the extruded fibre or film and before the stretching. Generally it is applied from a solution in a non-aqueous solvent. For instance non-aqueous lubricant solution may be applied on to the substantially dry fibre or film by a lick roller. Alternatively lubricant may be applied on to the fibre or film by spraying, usually from a non-aqueous solution.

The polymer solution is cross linked after extrusion and generally a cross linking system is included in the polymer solution. This cross linking system must be activatable after stretching the fibre or film and must be inert during and prior to the stretching.

Although the cross linking system can be a system that is activated by irradiation, for instance ultraviolet light, preferably it is a thermally activated system, in which event the rate of cross linking at the temperatures prevailing during the stretching and earlier stages of the process should be such that there is substantially no cross linking during these stages. By this means it is possible to optimise the stretching the fibre or film while the polymer is linear and then to fix the polymer in its stretched configuration by cross linking.

The substantially linear polymer is formed from a water soluble blend of monoethylenically unsaturated monomers that must, of course, be selected in known manner such that the final cross linked polymer is water absorbent. The monomer blend may be non-ionic, anionic or cationic, depending upon the liquids that are to be absorbed by the fibre or film. When a cationic monomer blend is to be used, this generally is formed of a mixture of a cationic monomer and a non-ionic monomer. Suitable cationic monomers are dialkylaminoalkyl (meth) -acrylates and -acrylamides, generally in the form of acid addition or quaternary ammonium salts. Any of the other cationic monomers that are suitable for incorporation into water absorbent, water insoluble, polymers can be used. Non-ionic monomer that may be included with the cationic monomers include (meth) acrylamide and any of the plasticising monomers discussed below.

Generally however the water soluble blend of monoethylenically unsaturated monomers is an anionic blend and comprises a carboxylic acid monomer, optionally with a non-ionic monomer. The monomers used in the invention may be allylic but are generally vinyl, most preferably acrylic monomers.

Suitable carboxylic monomers are maleic acid or preferably (meth) acrylic acid or any of the other conventional ethylenically unsaturated carboxylic acids, optionally with 2-acrylamido-2-methyl propane sulphonic acid or any of the other conventional ethylenically unsaturated sulphonic acids, or allyl sulphonate. Carboxylic and sulphonic monomers may be present in the final polymer in free acid or water soluble salt form, suitable salts being formed with ammonia, amine or alkali metal. The proportion of salt and free acid groups can be adjusted after formation of the cross linked polymer or after polymerisation of the linear polymer or before polymerisation. Generally the ratio of free carboxylic acid/alkali metal or other salt carboxylic acid groups in the final polymer (and often also in the monomers that are used to form the linear polymer) from 1:1 to 1:10. The ratio is usually at least 1:2 and often 1:3. It is generally below 1:6 and often below 1:5.

When the cross linking reaction involves reaction with the carboxylic acid groups it is often preferred that some at least of the carboxylic acid groups should be present as free acid groups before the cross linking occurs. For instance, for this purpose, it may be adequate for 10 to 75%, preferably 25 to 75%, of the acid groups to be in free acid form before the cross linking occurs.

Although the linear polymer is generally made by polymerisation of carboxylic acid monomer (in free acid or salt form) it is also possible to make the polymer by polymerisation of monomer that can be subsequently reacted to form the carboxylic acid monomer. For instance the carboxylic acid (as free acid or salt form) groups that are to be present in the cross linked monomer may be present initially in the linear polymer in the form of hydrolysable ester groups, such as methyl ester groups, that can then be hydrolysed while in the form of a linear polymer to yield carboxylic acid (free acid or salt) groups.

The monomeric material may comprise other monomers. These may be water soluble ethylenically unsaturated monomers such as acrylamide or may be a monomer that will provide groups for internal cross linking with the carboxylic groups (as discussed below) or may be a water insoluble monomer. For example the monomer may be an olefin, such as isobutylene (for instance for copolymerisation with maleic acid or anhydride) and/or the monomer may be a plasticising monomer, that is to say a monomer which results in the final polymer being more flexible and plasticised than it would be if the plasticising monomer had been replaced by a corresponding amount of the main absorbent monomer that is in the polymer, generally the anionic or cationic monomer.

Suitable plasticising monomers include aromatic ethylenically unsaturated monomers, such as acrylonitrile or styrenes (e.g., styrene or substituted styrenes), but they are preferably alkyl esters of (meth) acrylic acid or other suitable unsaturated carboxylic acid. Vinyl acetate and other vinyl esters may be used. The alkyl group of the ester generally contains less than 24 carbon atoms and usually 2 or more. Preferred alkyl groups contain 1 to 10 carbon atoms, especially ethyl and also higher alkyl groups such as 2-ethyl hexyl or other C6–C10 alkyl groups. Particularly preferred plasticising monomers are methyl or ethyl (meth) acrylate, butyl (meth) acrylate and 2-ethyl hexyl (meth) acrylate. They are generally present in amounts of at least 2% and preferably at least 10% since lower amounts tend to give inadequate benefit. The amount is usually below 50%, and generally below 45%, by weight based on the monomers used for forming the substantially linear polymer Other non-ionic monomers that may be used include ethylenically unsaturated monomers that carry a pendant group $-A_mB_nA_pR$ wherein B is ethyleneoxy, n is an integer of at least 2, A is propyleneoxy or butyleneoxy, m and p are each an integer less than n and preferably below 2 and most preferably zero, and R is a hydrophobic group containing at least 8 carbon atoms. It is usually a hydrocarbon group for instance allyl, aryl, aralkyl, alkaryl or cycloalkyl. The use of 1 to 50% by weight, generally 5 to 30% by weight, of such monomers can give plasticisation and can give improved absorptive capacity and non-tackiness, especially in aqueous electrolytes.

For a full description of suitable values of A, B, R, n, m and p, reference should be made to EP 0213799.

Hydroxyalkyl esters of ethylenically unsaturated carboxylic acids can also be included as plasticising monomer, the preferred esters being hydroxyalkyl (meth) acrylates. For optimum plasticisation the hydroxyalkyl group contains at least 6 carbon atoms, for instance 6 to 10 carbon atoms. They may be used, as plasticising monomers, in place of an equivalent amount of alkyl (meth) acrylate but, as explained below, the hydroxyalkyl (meth) acrylates can also be present to serve as internal cross linking agents.

When the polymer is cationic, the alkylene group in the described dialkylaminoalkyl group generally contains at least 2 carbon atoms, for instance 2 to 8 carbon atoms. The alkyl groups that are substituted on to the amino group generally contain 1 to 4 carbon atoms. Particularly preferred are dialkylaminoethyl (meth) acrylates and dialkylaminoalkyl (meth) acrylamides wherein the alkylene group is 1,3-propylene. However additional plasticisation can be obtained by selecting cationic groups in which the alkylene group and/or the alkyl substituents have larger numbers of carbon atoms, provided the monomer blend is still water soluble.

The substantially linear, water soluble, polymer may be formed from the monomer blend in any conventional manner. It may be pre-formed and then dissolved to form a polymer solution. For instance it may be made by reverse phase polymerisation if the monomer blend is soluble in water or by water-in-oil emulsion polymerisation if the blend is insoluble in the water, e.g., at a low pH. However this can incur the risk that the polymer may be contaminated by surfactant and this is undesirable. Preferably therefore the polymer is made by aqueous solution or other solution polymerisation methods. It may have been dried, but preferably not. Generally it is formed by solution polymerisation in the solvent in which it is to be extruded (generally water).

The polymerisation can be conducted in conventional manner in the presence of conventional initiators and/or chain transfer agents to give the desired molecular weight.

The concentration of polymer in the solution is generally in the range 5 to 50% and will be selected, having regard to the molecular weight of the polymer, so as to give a solution having a viscosity that is convenient for extrusion through the spinnerette or other extrusion device that is to be used. The concentration of polymer is usually at least 15%, with values of 20 to 40%, e.g., around 25 to 35%, often being suitable.

The solution that is extruded may have a viscosity as low as, for instance, 20,000 cPs at 20° C. but generally the viscosity is at least 70,000 and usually at least 100,000 and sometimes at least 120,000 cPs. It can be up to 150,000 or even 200,000 cPs. Higher values are generally unnecessary. All these viscosities are measured at 20° C. using a Brookfield RVT spindle 7 at 20 rpm. The viscosity desirably is also relatively high at the spinning temperature, which typically is elevated, for instance around 80° C. Preferably therefore the solution at 80° C. has a viscosity of at least 5 or 10,000 cPs and most preferably at least 20,000 cPs. For instance it may be in the range 50,000 to 100,000 cPs. These values may be obtained by extrapolation from values obtained using a Brookfield RVT viscometer spindle 7 at 20 rpm at a range of temperatures somewhat below 80° C.

The molecular weight of the linear polymer that is extruded may be as low as, for instance, 50,000 or 100,000 but preferably is above 300,000 and most preferably is above 500,000. For instance it may be up to 1 million or higher.

The solvent of the solution that is extruded is generally water but can be methanol or other suitable organic solvent or may be a blend of water and organic solvent. The solvent must be volatile so as to permit rapid evaporation after extrusion.

The linear polymer is cross linked after extrusion. The cross linking can be caused by reaction into the backbone of the linear polymer but preferably is by cross linking through pendant groups provided by one or more of the monomers that have been polymerised to form the linear polymer. The cross linking can be ionic, for instance as a result of exposing the linear polymer to any of the known ionic cross linking agents, preferably polyvalent metal compounds such as polyvalent aluminium compounds, for example aluminium sulphate. Organic compounds may be used instead of inorganic compounds to provide the cross linking.

Preferably however the cross linking is covalent between pendant groups in the linear polymer.

The covalent cross linking generally arises as a result of the formation of ester, amide (or imide) or urethane groups by reaction with carboxylic acid groups after extruding the polymer. Ester groups are preferred.

The reaction may be with an external cross linking agent. Various systems for externally cross linking the polymer are described in EP-A-0269393. Preferably however the polymer is internally cross linked, namely by reaction between reactive groups within the extruded polymer such as carboxylic groups with hydroxyl, epoxide or amide groups. Particularly preferred systems are described in detail in our EP-A-0268498. In these systems the extruded polymer is formed from a monomer blend comprising monomer that provides carboxylic acid monomer groups and monomer that provides hydroxyl groups that can react with the carboxylic acid groups to form ester cross linkages that contain only carbon and oxygen atoms in the linkages, and these carboxylic and hydroxylic groups are reacted after extrusion to form the said cross linkages. Generally the carboxylic acid groups are selected from acrylic acid and water soluble salts thereof and the hydroxylic groups are selected from vinyl alcohol, allyl alcohol, epoxide substituted vinyl monomers and hydroxy alkyl esters of vinyl carboxylic monomers.

Reference should be made to EP-A-0269393 and 0268498 for a full disclosure of suitable materials and methods for making extruded fibres and films.

Although the primary surprising benefits of the defined lubricants are obtained during the manufacture of the defined highly swellable extruded film or fibre, the lubricants can be used in other circumstances. For instance it is standard practice to make water swellable or water soluble polymeric material by bulk gel polymerisation and then to comminute and dry this gel, and the defined lubricant can be added to the gel before or during the comminution. Thus it may be blended into the gel from a solution, generally in a non-aqueous solvent, in the manner conventionally used for blending polyethylene glycol into the gel so as to give a film of polyethylene glycol on the surfaces of the comminuted particles. The comminuting and drying can be conducted in conventional manner, for instance by milling followed by fluid bed drying. The nature of the lubricant and its amount and the monomers from which the polymer is formed may all be as described above. When the polymer is to be water soluble then no cross linking is required but if the polymer is to be water swellable it must be cross linked and this is generally performed during the bulk gel polymerisation, for instance as a result of the inclusion of methylene bis acrylamide or other polyethylenically unsaturated cross linking agent, in known manner.

EXAMPLE 1

A linear copolymer having molecular weight just over 500,000 may be formed from 3% hydroxy propyl methacrylate, 40% methyl acrylate and 57% acrylic acid which is 75% neutralised as sodium acrylate. The solution is formulated to a concentration such that it has a viscosity (Brookfield RVT spindle 7 speed 20) of about 130,000 cPs at 20° C. and about 30,000 cPs at 80° C. (by calculation). The solution is spun as fibres through a multiple orifice spinnerette into a heated atmosphere in which they are quickly partially dried.

A solution in organic solvent of dihydrogenated tallow dimethyl ammonium chloride is applied on to the partially dried fibres by a lick roll and the fibres are stretched and wound up. They are then further heated to about 200° C. to effect curing. The application of the lubricant to the fibres after they are substantially dry to touch but before they are subjected to stretching and subsequent handling greatly reduces the risk of breakage of the fibres and contamination of the apparatus.

EXAMPLE 2

The process of Example 1 can be repeated successfully when the quaternary compound of Example 1 is replaced by oleo-ampho-carboxy glycinate, which is a fatty amphoteric quaternary compound of the formula:

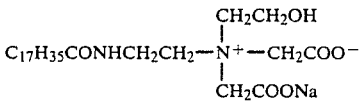

EXAMPLE 3

Bulk gel polymerisation was conducted in conventional manner on a blend of 25 parts acrylic acid, 0.0125 parts methylene bis acrylamide, sodium hydroxide to neutralise the acrylic acid, and water to give 100 parts solution. After polymerisation to form a gel, the gel was comminuted in the presence of one of various additives each additive being added as a solution in an appropriate solvent. Comminution was performed to give a particle size of about 1 to 3mm. This particulate gel was then fed to a pilot scale fluidised bed dryer having a first stage air temperature of 85° C. and a second stage air temperature of 95%.

An indication of the effectiveness of the various additives was obtained by noting the maximum feed rate which could be obtained before the fluidisation properties deteriorated, this being manifested by agglomeration of particles within the bed and the production of oversized particles and/or a collapse of particles on to the base of the dryer.

The samples were graded on a arbitary scale of 0 to 10 where 0 represented immediate aggregation upon feeding the gel particles into the dryer and 10 represented no aggregation. In this case the maximum feed weight was dictated by the drying capacity of the fluidised bed dryer. The additive was in each instance added at a level corresponding to 0.5% dry on dry.

A control was conducted in which the gel was comminuted and fed to the dry without any additive.

The results were as follows:

| Additive | Rating |
|---|---|
| Control | 1 |
| Ceto-stearyl alcohol | 4 |
| (Stearylmethacrylate/methylmethacrylate) (copolymer (2:1)) | 4 |
| Lauryl alcohol | 5 |
| Oleyl alcohol | 7 |
| Polyethylene glycol (600) | 5 |
| (Oleyl alcohol and stearyl methacrylate/) (methylmethacrylate copolymer (1:1)) | 8 |
| Di-hydrogenated tallow dimethyl ammonium chloride | 10 |
| Oleo-ampho0carboxy-glycinate | 10 |

This demonstrates the advantage of a counterionic material (which can optionally be amphoteric).

We claim:

1. A polymeric fibre or film which has a gel capacity of at least 50 grams deionized water per gram polymer at 20° C. and which has been made by extruding into a gaseous atmosphere a solution in a solvent of a substantially linear polymeric material formed from water soluble ethylenically unsaturated monomeric material comprising ionic monomer and thereby evaporating the solvent and forming polymeric fibre or film, stretching the fibre or film and cross linking the stretched fibre or film, the improvement which comprises having applied to the surface of the extruded fibre or film before or during the said stretching a solution of a counterionic lubricant compound and thereby absorbing the lubricant compound into the said surface.

2. The polymeric fibre or film which has a gel capacity of at least 50 grams deionized water per gram polymer at 20° C. and which has been made by extruding into a gaseous atmosphere a solution in a solvent of a substantially linear, amionic, polymeric material formed from water soluble ethylenically unsaturated monomeric material comprising ionic monomer and thereby evaporating the solvent and forming polymeric fibre or film, stretching the fibre or film and cross linking the stretched fibre or film, the improvement which comprises having applied to the surface of the extruded fibre or film before or during the said stretching a solution of a cationic lubricant compound and thereby absorbing the lubricant compound into the said surface.

3. A fibre or film according to claim 2 in which the solution of counterionic lubricant is applied to the surface of the fibre or film after the evaporation of most or all of the solvent.

4. The fibre or film according to claim 2 in which the solvent is water and the said solution has a viscosity, measured by Brookfield RVT viscometer spindle 7, of 20,000 to 100,000 cps at 80° C. and 70,000 to 200,000 cps at 20° C.

5. An element according to claim 2 in which the lubricant compound includes at least one hydrophobic hydrocarbon group of at least 8 carbon atoms.

6. An element according to claim 2 in which the lubricant compound is a quaternary ammonium compound having at least one hydrophobic hydrocarbon group of at least 8 carbon atoms on the quaternary nitrogen.

7. An element according to claim 2 in which the lubricant compound is a di-$C_{14-20}$-aliphatic-di-$C_{1-4}$-alkyl quaternary ammonium compound or an amphoteric fatty quaternary compound.

8. An element according to claim 2 in which the lubricant compound is di-hydrogenated tallow dimethyl ammonium chloride.

9. An element according to claim 2 in which the polymeric material is formed from 50 to 100% by weight ethylenically unsaturated carboxylic monomer and 0 to 50% ethylenically unsaturated non-ionic monomer and the lubricant compound is a cationic compound having at least one hydrophobic hydrocarbon group of at least 8 carbon atoms.

10. An element according to claim 9 in which the polymeric material is a copolymer of (meth) acrylic acid or maleic acid with water insoluble monomer.

11. An element according to claim 9 in which the polymeric material is formed at least 50% by weight (meth) acrylic acid, 0 to 15% by weight hydroxyl alkyl (meth) acrylate and 2 to 50% by weight of a plasticising monomer selected from alkyl (meth) acrylates, styrene and vinyl esters.

12. A fibre or film according to claim 2 made by extrusion into warm air of an aqueous solution of linear polymeric material made by aqueous solution polymerisation of monomeric material comprising ethylenically unsaturated carboxylic monomer, and the cross linking is by reaction between carboxylic groups in the polymer and amide, epoxy or hydroxyl groups in the polymer.

13. A fibre according to claim 12 in which the cross linking is by reaction between carboxylic groups and hydroxy alkyl groups in the polymer.

* * * * *